United States Patent [19]

Kittler et al.

[11] Patent Number: 4,937,055

[45] Date of Patent: Jun. 26, 1990

[54] SURFACE TREATMENT FOR THIN METAL OR SEMICONDUCTOR OXIDE COATINGS

[75] Inventors: Wilfred C. Kittler, Thousand Oaks; Darrell Stoddard, Malibu, both of Calif.

[73] Assignee: Andus Corporation, Canoga Park, Calif.

[21] Appl. No.: 297,143

[22] Filed: Jan. 13, 1989

[51] Int. Cl.[5] ..... B05D 5/12

[52] U.S. Cl. ..... 427/126.3; 427/126.4; 427/299; 427/302; 427/327; 427/343; 437/181

[58] Field of Search ..... 427/299, 302, 327, 343, 427/123, 126.3, 126.4; 437/181

[56] References Cited

U.S. PATENT DOCUMENTS 3,888,702 6/1975 Kujawa et al. ..... 148/6.14 R
3,935,349 1/1976 Terai et al. ..... 427/327 X

OTHER PUBLICATIONS

Arkles, Chemtech, Dec. 1977, pp. 766–778.
DuPont "Tyzor Titanates", brochure E-69996-1 (4/87).
Stobbe, Paper, Film and Foil Converter, Feb. 1988, pp. 72–77.
Enercon Industries brochure 1980.
Handbook of Thin Film Technology, Maissel & Glang, Eds., pp. 6–41, (McGraw-Hill 1970).
Handbook of Adhesive Bonding, Cagle, Ed., pp. 14–4 (McGraw-Hill 1982).

*Primary Examiner*—Michael Lusignan
*Attorney, Agent, or Firm*—Yuan Chao; Edith A. Rice; Herbert Burkard

[57] ABSTRACT

The adherablility of a thin coating of a metal or semiconductor oxide, such as indium tin oxide or silicon dioxide, is improved by treating the coating with an aqueous solution containing an effective amount of an active oxygen compound such as sodium hypochlorite or hydrogen peroxide.

27 Claims, 1 Drawing Sheet

SURFACE TREATMENT FOR THIN METAL OR SEMICONDUCTOR OXIDE COATINGS

BACKGROUND OF THE INVENTION

This invention relates to a method of surface treating thin coatings of metal or semiconductor oxides to improve their adherability.

Many thin coatings are subjected to subsequent processing steps in the manufacture of a finished product. These may include coating with a different material, marking, and lamination. In all such steps the coating must come into intimate contact and form a bond with an adherend. Often, the strength of this bond is important if not critical to satisfactory performance of the product. It has been proposed to improve the bond strength by treating the surface of either the coating or the adherend or by applying an intervening primer layer which will bond well to both the coating and the adherend.

Thin coatings made of oxides such as indium tin oxide (ITO) and tin oxide are useful in a number of products, ranging from electrooptical displays (e.g., electroluminescent or liquid crystal displays) to membrane switch panels to coatings having controlled optical properties in the infrared, visible, or ultraviolet spectral regions or specific combinations of electrical and optical properties. In some products, they may serve as a transparent electrical conductor. In other products, they may be designed to reflect light of a particular wavelength while transmitting light of a different wavelength either alone, or in conjunction with other layers of metals or metal oxides. Thus, depending on the product, either their electrical or optical properties, or both, is important. Also, in many applications these coatings must be in adherent contact with adjacent layers of material. However, these coatings do not always form good bonds with various other coatings and inks, unless they are treated to improve adhesion. Typically, problems occur with polar, water-borne, or hydrophilic (polar) adherends.

Many different kinds of primer layers are available to improve bond strengths. Arkles, in "Tailoring Surfaces with Silanes," *Chemtech,* Dec. 1977, p. 776, discusses the use of organosilanes for this purpose. Product literature from Du Pont on their Tyzor (TM) organotitanates (Brochure No. E69996-1, 4/87) teaches the use of these materials for adhesion promotion. (Such silanes and titanates are sometimes referred to as coupling agents.) However, the use of a primer layer or coupling agent entails the deposition of an intermediate material between the coating and the adherend, with an uncertain prognosis as to the long-term chemical compatibility of the three elements and an extra interface which must also have good bond strength. Also, the uniform deposition of a primer layer may require special equipment.

Known surface treatments include exposure to corona discharge, as discussed by Stobbe in *Paper, Film and Foil Converter,* Feb. 1988, p. 72 and in product literature by Enercon Industries Corp. (Menomonee Falls, Wis. It has been proposed to use a glow discharge in *Handbook of Thin Film Technology,* Maissel and Glang, Eds., pp. 6–41 (McGraw-Hill 1970), particularly in the presence of oxygen, for the purpose of volatizing organic residues by chemical reaction and of surface modification of the thin film.

In *Handbook of Adhesive Bonding,* Cagle, ed., p. 14–4 (McGraw-Hill 1982), a surface treatment for steel is taught, in which the steel is treated with an aqueous mixture of a strong acid (hydrochloric acid), hydrogen peroxide, and hexamethylene diamine. Apparently the former etches off any oxides on the steel surface, to provide a clean metallic bonding surface. The diamine, a chelating agent, then forms a passivating layer on the metal. The amino groups of the diamine make this technique particularly useful for enhancing adherability to amine-reactive materials such as epoxies and polyurethanes.

Kujawa et al., in U.S. Pat. No. 3,888,702 (1975) discloses another surface treatment using hydrogen peroxide. In this case, nickel is treated with aqueous hydrogen peroxide containing lead ion to enhance its bondability to silicone rubber.

In considering surface treatments, a distinction must be made between a treatment to remove contaminants and a treatment to modify the surface to improve its adherability. Contaminants are usually either particulate or organic residues and can be removed either by mechanical means, solvents, or combinations of both techniques. Sometimes both contaminant removal and surface modification may be required.

ITO and other metal, mixed metal, or semiconductor oxide coatings are typically deposited by vapor deposition techniques, among which sputtering is one of the better known ones. Vapor deposition techniques are considered to be "clean" techniques, that is, they deposit a uniform, uncontaminated coating. We have found that for such coatings, having a cleanly deposited surface is not a sufficient condition for ensuring good adherability and that their adherability is markedly improved by a surface treatment according to our invention. It is often necessary, due to the nature of the substrate or of the end product, for the freshly deposited coating to come into contact with another surface. For instance, in coating a roll of polymer film the coating is wound up upon the reverse side of the film. Similarly it is often necessary to put a protective cover sheet on a coating soon after removing it from the coating apparatus. We have discovered a new method for improving the adherability of thin metal or semiconductor oxide coatings.

SUMMARY OF THE INVENTION

This invention provides a method of treating a thin coating of a metal or semiconductor oxide to improve its adherability, comprising the steps of:

(a) providing an article having a thin coating of a metal or semiconductor oxide on a surface thereof and (b) treating the coating with an aqueous solution containing an effective amount of an active oxygen compound.

This invention further provides a method of making an improved bond to a thin coating of a metal or semiconductor oxide, comprising the steps of (a) providing an article having a thin coating of a metal or semiconductor oxide on a surface thereof;

(b) treating the coating with an aqueous solution containing an effective amount of an active oxygen compound; and (c) bonding an adherend to the treated coating.

DESCRIPTION OF PREFERRED EMBODIMENTS

Figure 1:
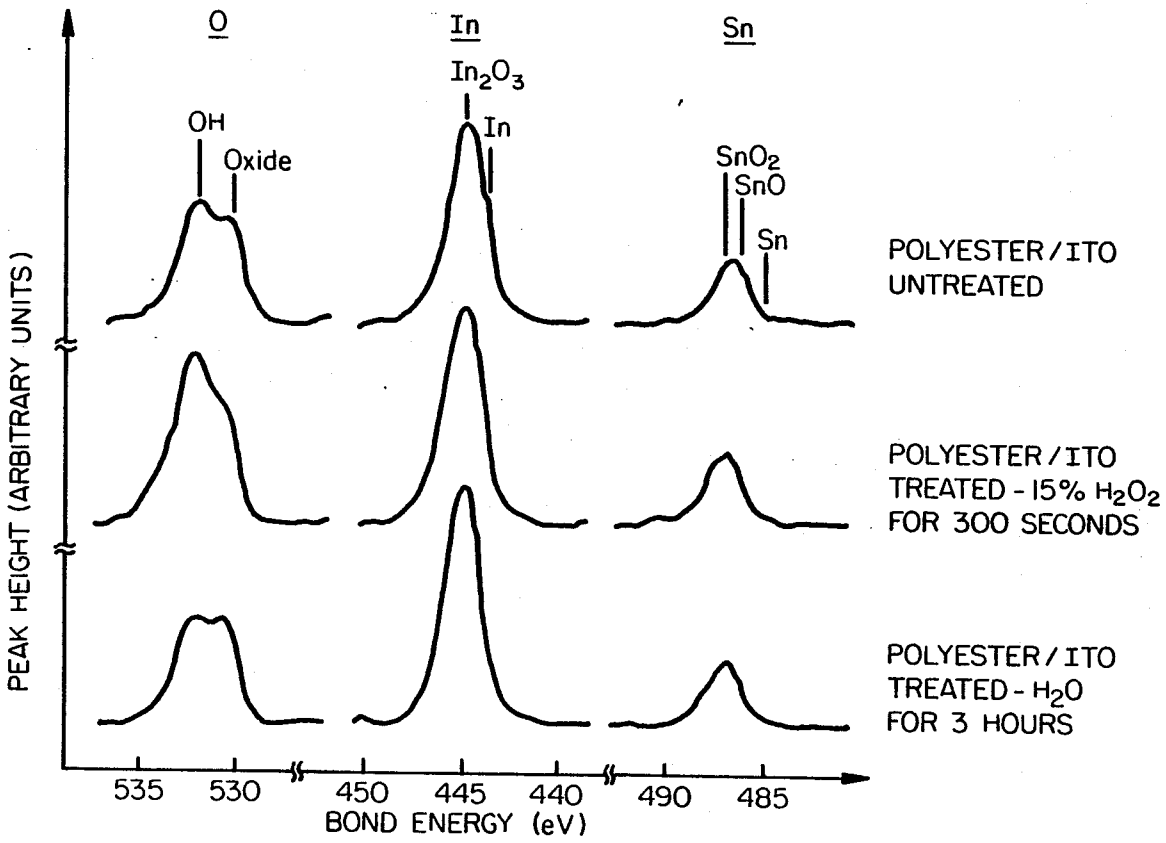
FIG. 1 shows the X-ray photoelectron spectroscopy spectra of ITO thin coatings before and after various periods of treatment according to this invention.

Metal oxides which can advantageously be treated according to our invention include the oxides of tin, indium, and zinc. The term "metal oxide" as used herein includes mixed metal oxides, for example indium tin oxide (ITO). It also includes the native oxide layers formed on the surfaces of metals which are known to grow relatively thick native oxide layers, for example titanium, tantalum, zirconium, aluminum, chromium, and hafnium. It does not include the minimal oxide layers which may form on the surface of inert or noble metals such as gold, platinum, silver, and nickel.

Semiconductor oxides which can advantageously be treated according to our invention include the oxides of silicon and germanium; mixed semiconductor oxides; and semiconductor oxynitrides of the formula $Si_xN_yO_z$, wherein x, y, and z are each less than about 2.

A preferred method for depositing the thin coatings is sputtering, in particular magnetron sputtering. Other suitable techniques include spray pyrolysis, chemical vapor deposition, ion plating, laser deposition, vacuum evaporation, and the like. For certain coatings, chemical plating may be used. In some instances, the coating may be deposited as elemental metal, then allowed to oxidize to the metal oxide. The thickness of the coating is not critical, although in many applications thicknesses between about 50 and about 10,000 Å, preferably between about 100 and about 2,000 Å are contemplated.

The exact active oxygen compound to be used is not critical, provided that it is water soluble. Examples of suitable active oxygen carriers include hydrogen peroxide; sodium hypochlorite; alkali metal (especially sodium) perborates, persulfates, and percarbonates; peracids (e.g. peracetic acid); peracid salts (e.g., salts of diperisophthalic acid, peracetic acid, or perbenzoic acid); peroxydiphosphate salts; sodium aluminum aminohydrogenperoxide; urea peroxyhydrate; peroxypyrophosphate salts; and the like. Sodium hypochlorite and hydrogen peroxide are preferred active oxygen compounds.

Preferably, the aqueous solution consists essentially of water and the active oxygen compound. What constitutes an effective amount of the active oxygen compound may vary somewhat on a case by case basis, depending on the particular active oxygen compound being used, the oxide coating being treated, the treatment time and temperature, etc., but those skilled in the art can readily determine empirically the amount to use. By way of illustrative teachings, sodium hypochlorite is preferably used at a concentration between about 0.5 and 15 per cent by volume, more preferably between about 1 and about 5 per cent by volume. Hydrogen peroxide may be used at a concentration of between about 0.1 and about 50 volume per cent, more preferably between about 0.1 and about 30 volume per cent. Generally, treatment for a short period of time, on the order of 10–60 seconds, at ambient temperature (approximately 25 ° C.), is sufficient.

The adherend which is to be bonded onto the treated coating may be of various types and may be bonded in various manners. For example, the adherend may be a curable resin which is coated onto the coating in the uncured form and then cured. Or, the adherend may be yet another thin coating which is deposited onto the treated coating by sputtering or like vacuum deposition technique. Or, the adherend may be laminated onto the coating.

It should be noted that the thin coatings to be treated according to our invention are somewhat fragile, in part because of their thinness. Many of the generic treatments disclosed in the adhesive art for improving adhesion are either ineffective or impractical. For example, an abrasive or etching treatment which relies on removing a surface layer may easily remove the entire coating or does not lead to the requisite improvement in adhesion. In contrast, treatment according to this invention for periods up to 3 hours does not appear to significantly remove any portion of the thin film. Other prior art treatments rely on strong chemicals (e.g. chromic acid), which may alter the delicate balance between the physical, optical, electrical, and adhesive properties which such thin films often must have. Our treatment improves adhesion without compromising the other properties. Yet other prior art techniques require special equipment such as plasma chambers which are either expensive or inconvenient to use on a large scale. Our invention uses a simple process which is easily performed on a large scale.

The practice of our invention can be more comprehensively understood by reference to the following examples, which are provided by way illustration, and not of limitation.

EXAMPLE 1

A sample of poly(ethylene terephthalate) (PET) 75 μm thick was coated with a transparent conductive coating of ITO by reactive magnetron sputtering. This coating had an electrical resistance of approximately 250 ohm/sq. and a visible light transmittance (VLT, the light transmittance over 400–700 nm and weighted to the human eye's response) of approximately 83%.

A sample of this ITO coated PET was treated by immersion in approximately 15 weight per cent hydrogen peroxide at ambient temperature for 30–60 seconds, and then coated with Cyanoresin CR-5 (Shinetsu Chemical Industries, Japan), a cyanoethyl cellulose resin, on the ITO side to a thickness of 30–50 microns. The coated ITO was tested for adhesion by the method of ASTM D3359, which semiquantitatively estimates the adhesion of coatings. It showed 100% adhesion of the cyanoethyl cellulose to the ITO.

The results with the hydrogen peroxide treated sample compared favorably with those obtained by coating the ITO with a primer layer of either nickel or palladium (each about 25 Å thick, applied by magnetron sputtering). These samples, after coating with the cellulosic material, also exhibited 100% adhesion of the cyanoethyl cellulose to the ITO.

In comparison, when a sample of this ITO coated PET was directly coated with the cyanoethyl cellulose (that is, without the hydrogen peroxide treatment), testing under the same conditions showed 100% failure of adhesion of the cyano ethyl cellulose to the ITO.

EXAMPLE 2

Samples of the same ITO coated PET were subjected to various procedures as shown in Table I, and then coated on the ITO side with a glycol containing polyester resin derived from terephthalic acid and containing conductive silver particles, available as product DWE-114 from Toyobo Corporation, Japan. The samples were then tested for adhesion between the polyester resin and the ITO by ASTM D3359. The results are provided in Table I.

TABLE I

| Sample | Treatment | Adhesion to ITO (%) |
|---|---|---|
| A | None | 0 |
| B | Ni layer sputtered on | 90–95 |
| C | Pd layer sputtered on | 100 |
| D | Ni layer sputtered on, then treated with hydrogen peroxide (*) | 100 |
| E | Treated with hydrogen peroxide (*) | 100 |
| F | Water (**) | 90 |

*5–15% aq. $H_2O_2$ for 30–60 sec. at ambient temperature
**2 hr at ambient temperature Additionally, experiments were performed with conductive inks manufactured by Acheson Corporation (U.S.A.) and Fujikura (Japan). In each instance improved adhesion was observed in the hydrogen peroxide treated samples, as compared to the untreated samples.

EXAMPLE 3

This example illustrates the convenient practice of our invention in a large scale and permanence of the benefits accruing from treatment of a thin film surface according to it.

Many sheets of ITO coated PET film were immersed in 15 volume % hydrogen peroxide solution for 120 sec and rinsed in water for 5 sec. (The hydrogen peroxide solution was refreshed with 2–3 vol. % hydrogen peroxide every 50 sheets.) The sheets were then hot air dried for 4 sec at 120 ° C., placed in an oven whose temperature was programmed to rise from 82 ° C. to 130 ° C. over 13 min, and left in there for 2 min. The sheets were removed from the oven, coated with the cellulosic material of Example 1, and tested for their electrical, optical, and adhesive properties. The results comparing hydrogen peroxide treated and untreated sheets are provided in Table II.

TABLE II

| Parameter | Untreated | Treated |
|---|---|---|
| Resistance (ohm/sq.) | 243 | 268 |
| Transmittance @ 550 nm (%) | 83 | 83 |
| Transmittance @ 400 nm (%) | 72 | 70 |
| Reflectance @ 550 nm (%) | 12 | 12 |
| Reflectance @ 400 nm (%) | 17 | 18 |
| Adhesion (%) | 0 | 100 |

These results show that while electrical and optical properties for treated and untreated film are virtually identical, the treated film has much superior adhesion properties, the untreated film being essentially nonadhesive to the cellulosic coating while the treated film is 100% adhesive.

Treated samples (both coated and uncoated) were monitored for changes with time, every week for four weeks. No changes in adhesion in either the coated or uncoated samples were observed over this period. These results show that the treatment is durable, that is, the ITO does not need to be coated immediately afterwards. From a convenience viewpoint, this is an important consideration. The results also show that, once bonded, the increased adhesive strength is durable, too.

EXAMPLE 4

In this example, a quick screening test is used to show the relative effects of various treatment parameters.

It is known that a surface must be wetted by a coating or adhesive for a bond to occur between that surface and the coating or adhesive. That is, the surface tension of the coating or adhesive must be less than the free surface energy or critical surface tension of the surface. In turn, the wettability of different surfaces are readily compared by measuring the contact angles made by a drop of a liquid on each surface. See, e.g., *Handbook of Adhesive Bonding,* Cagle, Ed., chapter 2 (McGraw-Hill 1973) or "Contact Angle, Wettability and Adhesion," *Advances in Chemistry Series,* Gould, Ed., Vol. 43 (Amer. Chem. Soc. 1964).

Accordingly, in this example the effect of various treatment conditions on the wettability of various thin films by water and ethylene glycol was studied. The lower portion of a small strip of the test sample was soaked in the test solution for a predetermined period of time. Both sides of the sample were rinsed well in running water, then held vertically for 30 sec to determine whether the immersed portion was better wet by water than the unimmersed portion.

The effect on wettability by ethylene glycol was tested as follows: A treated and rinsed sample was air dried or blown dry with clean compressed inert gas, without allowing the surface to come into contact with any other material. Drops of ethylene glycol were placed on the surface and the angle formed by the drops compared with the angle formed on a clean but untreated surface.

The results are provided in Table III.

TABLE III

| Sample | Time (sec) | Treatment (*) NaOCl (vol %) 5 | NaOCl (vol %) 1 | $H_2O_2$ (vol %) 3 | $H_2O_2$ (vol %) 1 | $H_2O_2$ (vol %) 0.5 | Water |
|---|---|---|---|---|---|---|---|
| A | 10 | Y | N | Y | N | N | N |
| | 30 | Y | Y | Y | Y | N | N |
| | 60 | Y | Y | Y | Y | Y | N |
| B | 10 | Y | Y | Y | N | N | N |
| | 30 | Y | Y | Y | Y | N | N |
| | 60 | Y | Y | Y | Y | Y | N |
| C | 10 | Y | N | Y | N | N | N |
| | 30 | Y | Y | Y | Y | N | N |
| | 60 | Y | Y | Y | Y | N | N |
| D | 10 | Y | N | N | N | N | N |
| | 30 | Y | Y | Y | N | N | N |
| | 60 | Y | Y | Y | Y | N | N |

A = ITO (20 atom % tin) on PET (175 μm), surface resistance 75 ohm/sq. and VLT 82%
B = ITO (10 atom % tin) on PET (100 μm), surface resistance 300 ohm/sq. and VLT 83%
C = Tin oxide on PET (100 μm), VLT 82%
D = silicon dioxide (1000 Å) on polyimide film (50 μm)
*Y means sample was water wettable and contact angle of ethylene glycol was reduced compared to untreated surface; N means sample was not water wettable and contact angle of ethylene glycol was not reduced.

EXAMPLE 5

X-ray photoelectron spectroscopy (XPS) spectra were taken of the surfaces of an ITO thin film (10 atom % tin) untreated, treated for 300 sec in 15 % hydrogen peroxide, and 3 hr in 15 % water. These spectra are shown in FIG. 1. They suggest that there has been some modification in the oxide peak, possibly due to a hydroxyl group being grafted onto the oxygen site. However, they also show that the ITO film has not been etched away, as might happen with other forms of surface treatment.

EXAMPLE 6

In an attempt to determine whether improved wettability was merely caused by etching a thin layer from the surface of the thin film, an 80 ohm/sq. ITO thin film (20 atom % tin) was immersed in 2N sulfuric acid for 2–4 min, during which the resistance of the coating increased to 84 ohm/sq, indicating partial removal of the thin film. (Sulfuric acid is a known etchant which will remove the entire ITO film if allowed to attack it for sufficiently long time.) The water wettability of the etched film was not improved.

EXAMPLE 7

In this example, the durability of a surface treatment according to this invention is assessed.

An 80 ohm/sq. ITO thin film (20 atom % tin) was rendered water wettable following the procedure of the previous examples. It was then treated with acetone, isopropyl alcohol, sulfuric acid, hydrochloric acid, or potassium hydroxide. After each of these treatments, it was found to be no longer wettable. Also, wiping the surface with a clean cloth also made it no longer wettable.

While we do not wish to be bound by any particular theory, the results of this example combined with the results of Examples 3, 5 and 6 suggest to us that the improved wettability is not due to a removal of surface contaminants or even a thin layer of the ITO to produce a clean, fresh surface for adhesion, but due to a chemical modification of the ITO surface. Further, this modification, if left undisturbed, is a durable one.

We claim:

1. A method of treating an article having a thin coating of a metal or semiconductor oxide to improve its bondability, comprising the steps of:

(a) providing an article having a thin coating of a metal or semiconductor oxide on a surface thereof, and (b) treating said coating with an aqueous solution consisting essentially of water and an effective amount of an active oxygen compound.

2. A method according to claim 1 wherein said coating comprises indium tin oxide.

3. A method according to claim 1 wherein said coating comprises tin oxide.

4. A method according to claim 1 wherein said coating comprises indium oxide.

5. A method according to claim 1 wherein said coating comprises silicon dioxide.

6. A method according to claim 1 wherein said coating is between about 50 and about 10,000 Å thick.

7. A method according to claim 1 wherein said active oxygen compound is sodium hypochlorite.

8. A method according to claim 7 wherein the sodium hypochlorite is present in an amount between about 0.5 and about 15 volume per cent.

9. A method according to claim 1 wherein said active oxygen compound is hydrogen peroxide.

10. A method according to claim 9 wherein the hydrogen peroxide is present in an amount between about 0.1 and about 30 volume per cent.

11. A method of making an improved bond to a thin coating of a metal or semiconductor oxide, comprising the steps of (a) providing an article having a thin coating of a metal or semiconductor oxide on a surface thereof;

(b) treating said coating with an aqueous solution consisting essentially of water and an effective amount of an active oxygen compound; and (c) bonding an adherend to the treated coating.

12. A method according to claim 11, wherein said coating comprises indium tin oxide.

13. A method according to claim 11, wherein said coating comprises tin oxide.

14. A method according to claim 11, wherein said coating comprises silicon dioxide.

15. A method according to claim 11, wherein said coating is between about 50 and about 10,000 Å thick.

16. A method according to claim 11 wherein said active oxygen compound is sodium hypochlorite.

17. A method according to claim 16 wherein the sodium hypochlorite is present in an amount between about 0.5 and about 15 volume per cent.

18. A method according to claim 11 wherein said active oxygen compound is hydrogen peroxide.

19. A method according to claim 18 wherein the hydrogen peroxide is present in an amount between about 0.1 and about 30 volume per cent.

20. A method according to claim 11, wherein in said bonding step said adherend is a curable resin which is applied onto the treated coating and then cured.

21. A method according to claim 11, wherein in said bonding step said adherend is a further thin coating which is deposited onto the treated coating.

22. A method according to claim 1, wherein the metal or semiconductor oxide is a native oxide of titanium, tantalum, zirconium, aluminum, chromium, or hafnium.

23. A method according to claim 1, wherein the metal or semiconductor oxide is an oxide of silicon or germanium; a mixed semiconductor oxide; or a semiconductor oxynitride of the formula $Si_xN_yO_z$, wherein x, y, and z are each less than about 2.

24. A method according to claim 11, wherein the metal or semiconductor oxide is a native oxide of titanium, tantalum, zirconium, aluminum, chromium, or hafnium.

25. A method according to claim 11, wherein the metal or semiconductor oxide is an oxide of silicon or germanium; a mixed semiconductor oxide; or a semiconductor oxynitride of the formula $Si_xN_yO_z$, wherein x, y, and z are each less than about 2.

26. A method according to claim 1, wherein said active oxygen compound is selected from the group consisting of hydrogen peroxide; sodium hypochlorite; alkali metal perborates, persulfates, and percarbonates; peracids; peracid salts; peroxydiphosphate salts; sodium aluminum aminohydrogen peroxide; urea peroxyhydrate; and peroxypyrophosphate salts.

27. A method according to claim 11, wherein said active oxygen compound is selected from the group consisting of hydrogen peroxide; sodium hypochlorite; alkali metal perborates, persulfates, and percarbonates; peracids; peracid salts; peroxydiphosphate salts; sodium aluminum aminohydrogen peroxide; urea peroxyhydrate; and peroxypyrophosphate salts.

* * * * *